United States Patent [19]

Wright

[11] Patent Number: 5,068,593

[45] Date of Patent: Nov. 26, 1991

[54] PIECE-WISE CURRENT SOURCE WHOSE OUTPUT FALLS AS CONTROL VOLTAGE RISES

[75] Inventor: Michael E. Wright, Berkeley, Calif.

[73] Assignee: National Semiconductor Corp., Santa Clara, Calif.

[21] Appl. No.: 597,830

[22] Filed: Oct. 15, 1990

[51] Int. Cl.[5] ..... G05F 3/26

[52] U.S. Cl. ..... 323/315; 307/296.6

[58] Field of Search ..... 323/312, 313, 314, 315, 323/316; 307/296.1, 296.5, 296.6, 296.7, 296.8

[56] References Cited

U.S. PATENT DOCUMENTS

| | | | |
|---|---|---|---|
| 3,648,154 | 3/1972 | Frederiksen et al. | 323/313 |
| 4,157,493 | 6/1979 | Monticelli | 323/314 |
| 4,214,176 | 7/1980 | Kushner | 307/296.6 |
| 4,642,551 | 2/1987 | Miller | 313/314 |

*Primary Examiner*—Peter S. Wong

*Attorney, Agent, or Firm*—Steven F. Caserza; Michael Glenn

[57] ABSTRACT

A Safe Operating Area (SOA) circuit is constructed including a synthetic large value resistor that is an active current source whose output current is related to the power supply voltage, and whose absolute value may be arbitrarily low. A piece-wise current source is provided which includes means for generating one or more control voltages in order to control the level of output current in response to the input voltage. In one embodiment, each of the control signal means includes feedback means and a summing node, so that one or more functions are performed using a control signal as an input, with the result fed back to the summing node. In this manner, a complex function can easily be provided for controlling the magnitude of the output current. In one embodiment, the one or more control signals are provided by one or more saturating current mirrors in order to limit the output current made available. The saturating current mirror comprises a bipolar transistor having a plurality of collectors, one of the collectors serving to provide the output current, and one or more collectors connected to circuit elements which have current characteristics with respect to the input voltage. In another embodiment, the bipolar transistor having a plurality of collectors is replaced by a plurality of MOS transistors, having channel widths of desired ratios in order to provide a desired transfer function.

20 Claims, 5 Drawing Sheets

PIECE-WISE CURRENT SOURCE WHOSE OUTPUT FALLS AS CONTROL VOLTAGE RISES

INTRODUCTION

BACKGROUND

This invention relates to voltage regulator output power transistor safe operating area protection (SOA).

A wide variety of protection techniques are known in the prior art, including techniques which reduce output transistor conduction by reducing base (or gate) drive to synthesize current limits, overvoltage limits, and junction temperature limits. What the continuous safe area limit techniques (as opposed to the more simple digital on/off protection techniques) have in common is a resistor that senses the supply voltage for the current limit circuit. However, when the quiescent current of the circuit must be made very low, the required resistor becomes an inefficient solution. For example, a 3 MΩ resistor sensing a 30 supply draws 10 μA. (A resistor having much higher resistance will consume excessive integrated circuit die area). This amount of current, plus the current consumed by the remainder of the current limiting circuitry, is unacceptably high.

FIG. 1 is a schematic diagram of a typical prior art current source, utilizing resistor 11 to sense supply voltage $V_{in}$. The circuit of Figure FIG. 4 is a schematic diagram of a typical prior art multiplying power limit circuit 200. Circuit 200 includes differential amplifier 230 which provides a control signal to the base of output transistor 205, which in turn controls output voltage $V_{out}$. The output current available on output lead 203 is controlled by differential amplifier 230, in response to input voltage $V_{in}$ applied to lead 201. Transistor 206 is connected in parallel with output transistor 205 in order to mirror the current flowing through output transistor 205. PNP transistor 207 is connected as a load device having one of its collectors 207-1 connected to its base and in turn connected to the collector of transistor 206. Collector 207-2 of transistor 207 provides a current which mirrors the current flowing through collector 207-1 of transistor 207. This mirrored current is applied to load device 208, which in turn causes current source 209 to mirror the current flowing through transistor 208. Current source 209 feeds differential transistor pair 213 and 214, with transistor 213 receiving its base drive input signal from output lead 203. A resistive voltage divider formed of resistors 210 and 211 (having resistances $R_2$ and $R_1$, respectively) is connected between $V_{in}$ lead 201 and $V_{out}$ lead 203, and provides a voltage to the base of differential transistor 214. Transistor 215 serves as a load device connected between $V_{in}$ lead 201 and the collector of transistor 213. Transistor 216 mirrors the current flowing through transistor load device 215, and has its collector connected to the inverting input lead of differential amplifier 230 and to the collector of differential input transistor 214. The non-inverting input lead of differential amplifier 230 is connected to a bias voltage above ground provided by bias circuitry 204.

A negative feedback loop includes amplifier 230, pass transistor 205, and the transconductance amplifier consisting of transistors 209, 213, 214, 215, and 216. Because of the high loop gain, the voltages on the inverting and non-inverting input leads of amplifier 230 are forced to be equal. The voltage drop across resistor 212 (having resistance $R_3$) is therefore equal to the offset voltage $V_{offset}$ depicted as 231.

If $I_x$ is the output current of the transconductance amplifier then $$I_x = \frac{V_{offset}}{R_3} \tag{1}$$

Also, $$I_x = G_M V_{R2}; \text{ where} \tag{2}$$

$$V_{R2} = \text{the voltage drop across resistor 210 having resistance } R_2 = \frac{(V_{in} - V_{out})R_2}{R_1 + R_2}; \text{ and} \tag{3}$$

$$G_M = \text{transconductance} = \frac{I_{c209}}{2V_T}; \text{ where} \tag{4}$$

$V_T$ = the thermal voltage $KT/q$; and, due to current mirrors of transistors 205 and 206, 207, and 208 and 209

$$I_{c209} = \frac{I_{out}}{N}; \text{ where}$$

$I_{c209}$ is the collector current of transistor 209;
$I_{out}$ is the emitter current of pass transistor 205; and
$N$ is a proportionality factor.

Eq. (2) thus becomes $$I_x = \frac{I_{out}}{2NV_T} \times \frac{(V_{in} - V_{out})R_2}{R_1 + R_2} \tag{5}$$

Setting this equal to Eq. (1) we get $$\frac{I_{out}(V_{in} - V_{out})K}{2NV_T} = \frac{V_{offset}}{R_3}; \tag{6}$$

where $$K = \frac{R_2}{R_1 + R_2}$$

or $$I_{out}(V_{in} - V_{out}) = \frac{2NV_T \times V_{offset}}{KR_3} \tag{7}$$

Since $I_{out}(V_{in} - V_{out})$ equals the power dissipation of pass transistor 205, the circuit of FIG. 4 gives a constant power dissipation.

Unfortunately, prior art circuit 200 of FIG. 4 is undesirably sensitive to manufacturing tolerances, for example the inherent DC offset voltage $V_{offset}$ of differential amplifier 230. Furthermore, prior art circuit 200 requires large value resistors 210 and 211 connected between $V_{in}$ lead 201 and $V_{out}$ lead 203, which are difficult to fabricate on an integrated circuit to precise tolerances, and require a large amount of integrated circuit area.

It is an object of this invention to provide a current source whose output falls as $V_{in} - V_{out}$ rises.

It is a further object of the invention to provide a current source whose output current may vary as a wide range of functions of $V_{in}-V_{out}$ It is still a further object of the invention to produce the output current as a function of $V_{in}-V_{out}$ with any absolute value of current, supply current, and without large valued resistors.

SUMMARY OF THE INVENTION

In accordance with the teachings of this invention, a circuit is constructed to limit power transistor conduction to within its safe operating area (SOA), the circuit synthetic large value resistor that is an active current source whose output current is related to the power supply voltage, and whose absolute value may be made arbitrarily low. To implement a complex SOA protection function, the SOA circuit of this invention synthesizes currents that are nonlinear fractions of voltage and has a topology that allows the current source output current to be a function of many variables such as junction temperature and machine state.

The topoloqy of the invention makes it flexible in terms of the transfer function that may be synthesized, and the invention relates to a current source whose voltage-to-current transfer function may synthesize a wide variety of functions such as a linear resistor, a nonlinear resistor, and a negative resistor. The transfer functions are piece-wise approximations of the desired functions, with as many pieces as desired for a desired accuracy in generating the transfer functions.

The invention generally relates to the generation of a current that is a piece-wise function of a control voltage.

In accordance with the teachings of this invention, a novel piece-wise current source is provided which includes means for generating one or more control voltages in order to control the level of output current in response to the input voltage. In one embodiment of this invention, each of the control signal means includes feedback means and a summing node, so that one or more functions are performed using a control signal as an input, with the result fed back to the summing node. In this manner, a complex function can easily be provided for controlling the magnitude of the output current.

In one embodiment of this invention, the one or more control signals are provided by one or more saturating current mirrors in order to limit the output current made available.

In one embodiment of this invention, the saturating current mirror comprises a bipolar transistor having a plurality of collectors, one of the collectors serving to provide the output current, and one or more other collectors connected to circuit elements which have current characteristics with respect to the input voltage. In one embodiment, these other collectors are connected to one or more zener diodes in order to provide a current path through these collectors when the input voltage increases above the predetermined level, thereby decreasing the output current available. In one embodiment of this invention, the circuit elements connected to the collectors provide equal step sizes of the output current to input voltage transfer function, while in another embodiment these steps are made unequal in any desired configuration. In another embodiment of this invention, the collector areas vary among the various collectors, thereby providing a desired ratio among the steps of the transfer function.

In another embodiment of this invention, the bipolar transistor having a plurality of collectors is replaced by a plurality of MOS transistors, having channel widths of desired ratios in order to provide a desired transfer function

DETAILED DESCRIPTION

Figure 1:
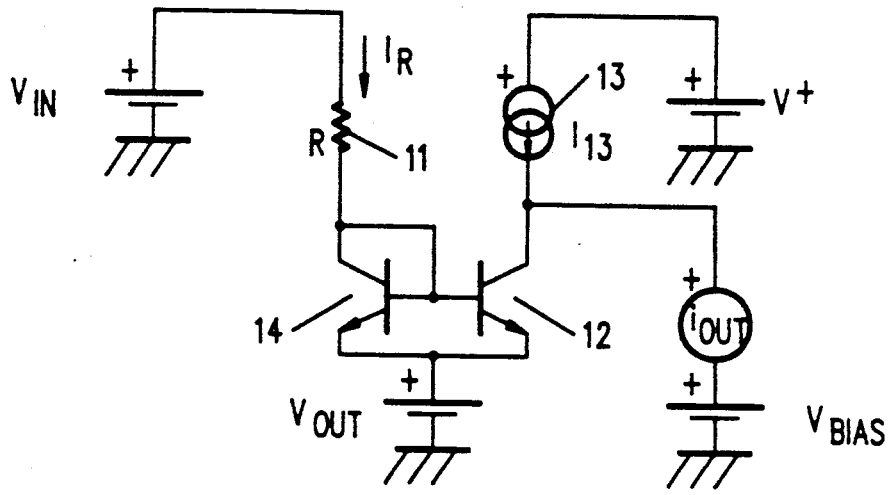
(PRIOR ART) FIG. 1
FIG. 1 is a schematic diagram of a typical prior art current source.
Figure 2:
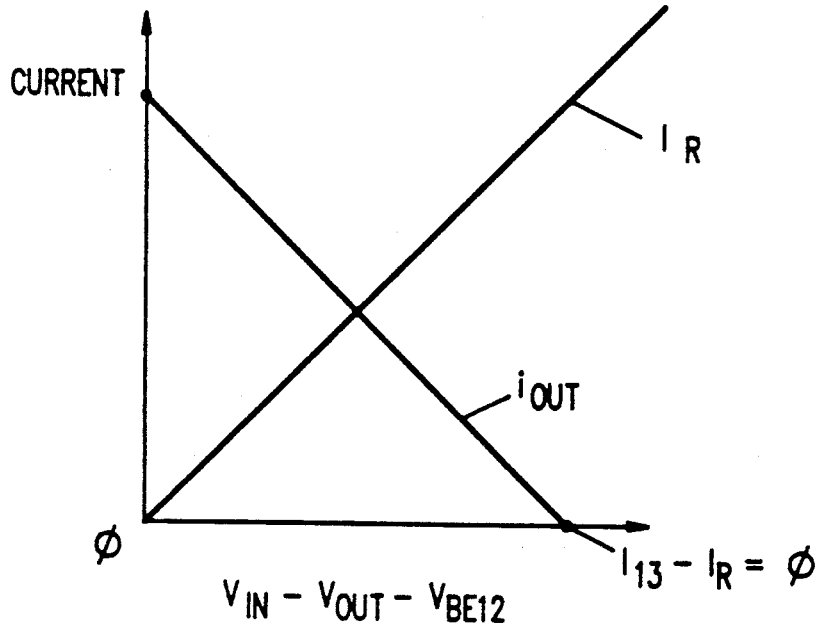
FIG. 2 is a graph depicting the operation of the circuit of FIG. 1.
Figure 3:
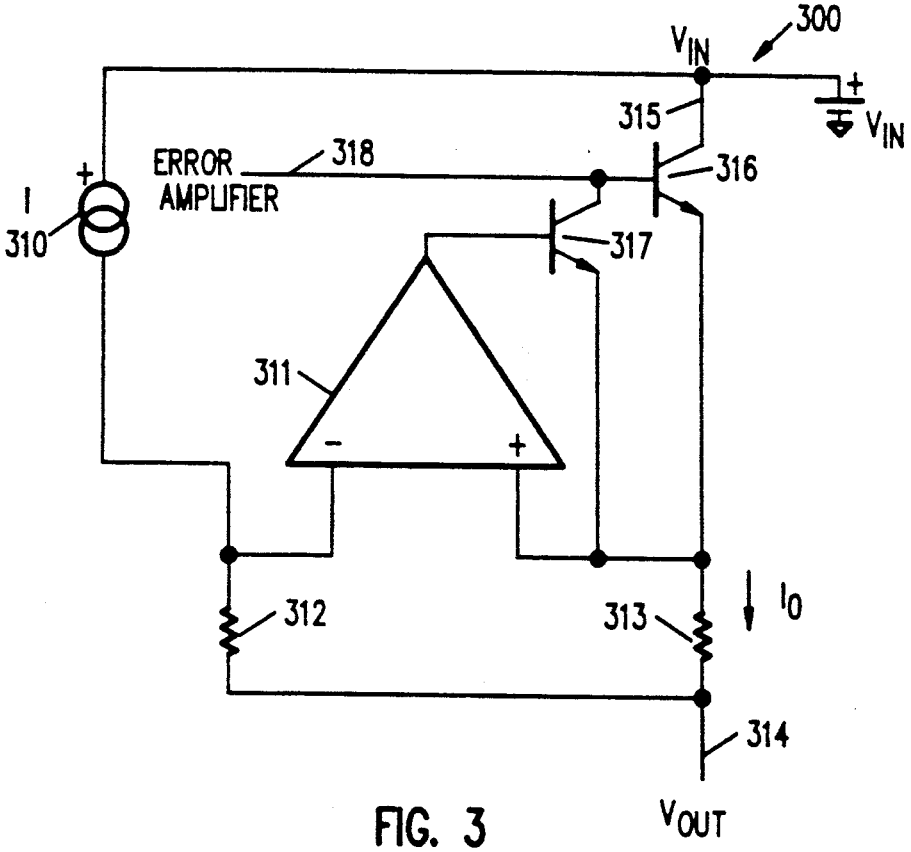
FIG. 3 is a schematic diagram depicting a prior art current limit circuit which, when used with the current source of FIG. 1, limits the power dissipation of a pass device.
Figure 4:
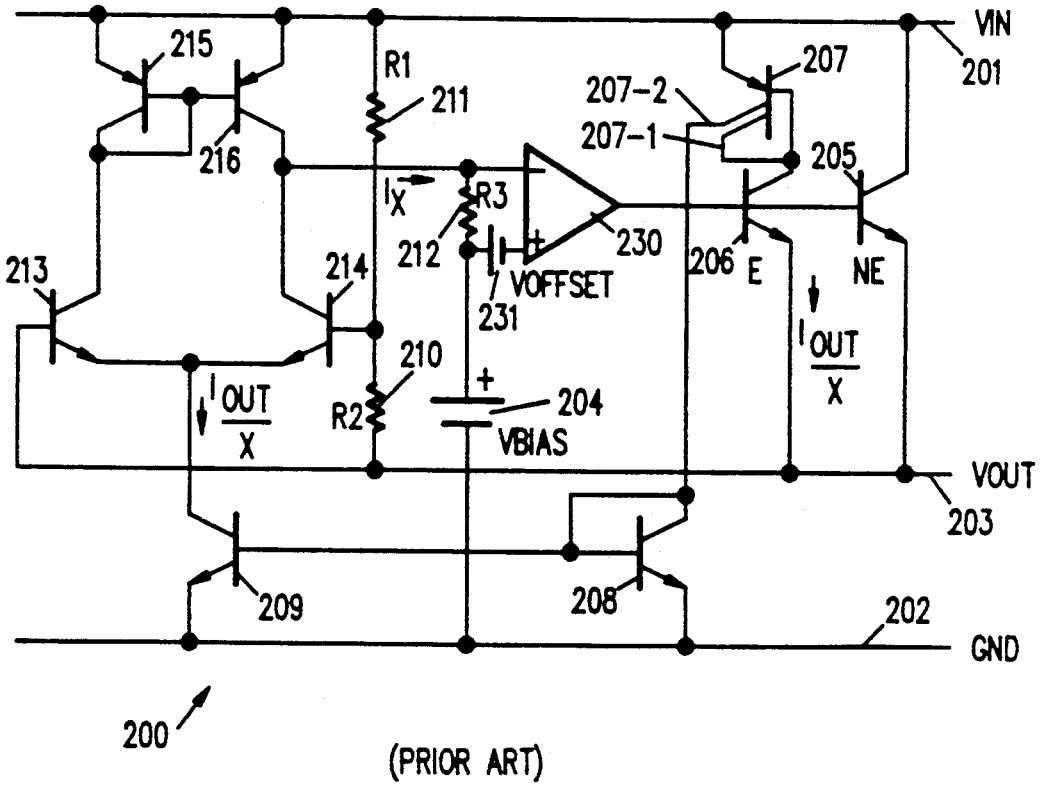
(PRIOR ART) FIG. 4
FIG. 4 is a schematic diagram depicting a prior art multiplying power limit circuit.
Figure 5A:
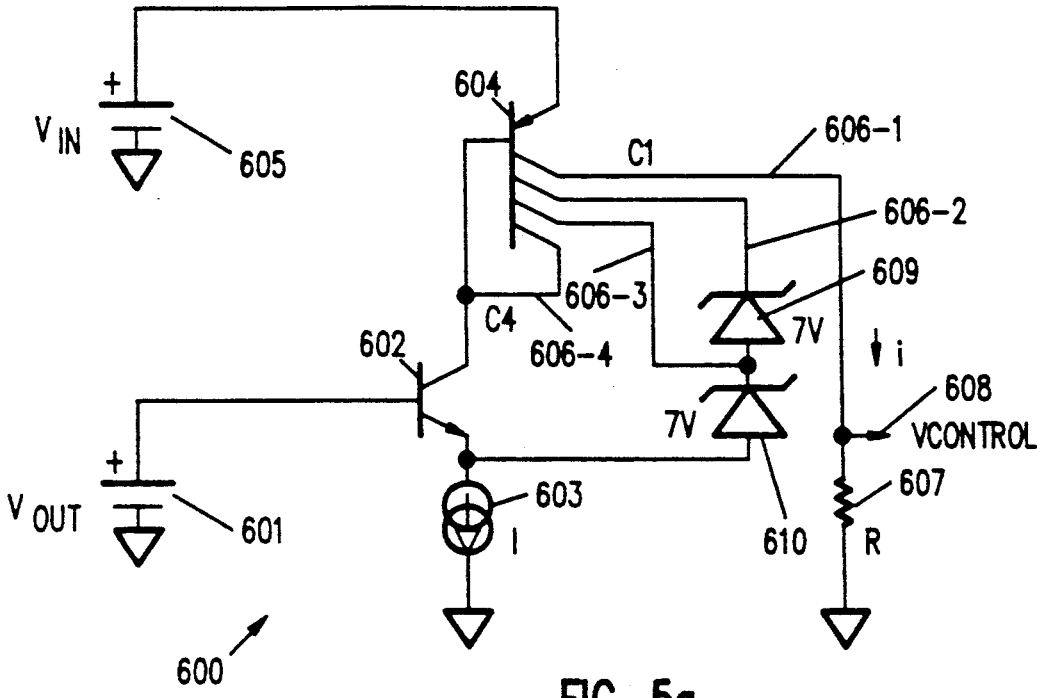
FIG. 5*a* is a schematic diagram of one embodiment of a current source constructed in accordance with the teachings of this invention utilizing a bipolar transistor having a plurality of collectors.
Figure 5B:
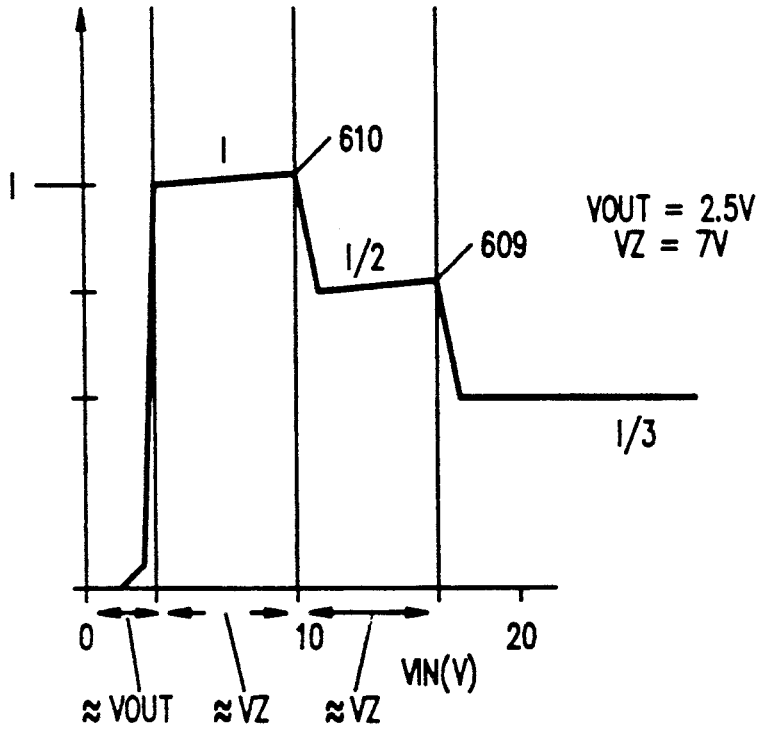
FIG. 5*b* is a graph depicting the transfer function of the circuit of FIG. 5*a;*

The objects of this invention are obtained in the embodiment of this invention depicted as circuit 600 of FIG. 5*a,* which operates as follows with reference to the graph of FIG. 5*b.* When $V_{in}$ is a high voltage (above $V_{out}-V_{be}+7v+7v \geqq \simeq 20$ volts) all collectors 606-1 through 606-4 of multiple collector lateral PNP transistor 604 are active and conducting (equally, if collectors 606-1 through 606-4 are matched). Since collectors 606-1 through 606-4 are matched, of the current I provided by current source 603, I/3 passes through transistor 602 via collector 606-4, and I/3 passes through collector 606-3, I/3 passes through collector 606-2. Therefore, I/3 flows from collector 606-1 through resistor 607, shown here being grounded, for simplicity. As $V_{in}$ falls, collector 606-2 is the first to saturate, with the current conducted by collector 606-2 falling to zero. Neglecting the controllable effects of collector 606-2 emitting minority carriers to its neighboring collectors, I/2 now flows through transistor 602 from collector 606-4, I/2 flows through collector 606-3, and I/2 flows through collector 606-1 as output current. The resulting output voltage increases, as shown as point 609 in the graph of FIG. 5*b.* As $V_{in}$ falls further, collector 606-3 saturates and its current falls to zero. There is now no feedback current, the circuit is operating open-loop, transistor 602 conducts current I from collector 606-4, and collector 606-1 is conducting I as output current. The output voltage rises further, as shown at point 610 of the graph of FIG. 5*b*.

In one embodiment, $V_{in}$ is 5 volts and $V_{out}$ applied to the base of transistor 602 is a constant 2.5 volts, for convenience and in order to allow circuit 600 to be operational with $V_{in}$ of as low approximately 2.5 volts. The relative widths of each collector of transistor 604 are selected to provide the desired transfer function. For example, the transfer function of circuit 600 for matched collectors, as shown in FIG. 5*b*, allows greater power dissipation at low $V_{in}$ where the power transistor (not shown, but typically formed as a portion of a voltage regulator integrated circuit which is controlled by control voltage $V_{control}$) can dissipate more power.

In one embodiment, transistor 604 is formed as four separate transistors having their emitters connected in common and their bases connected in common. The base width associated with collector 606-1 is wider than the base widths associated with collectors 606-2 through 606-4 in order to reduce the effect of size of collector 606-1 relative to the sizes of collectors 606-2 through 606-4, and to increase the output resistance. In one embodiment, transistor 604 is formed including P type guard rings to minimize the collection by the usually active collectors 606-1 and 606-4 of minority carriers emitted by the saturated collectors.

Figure 6:
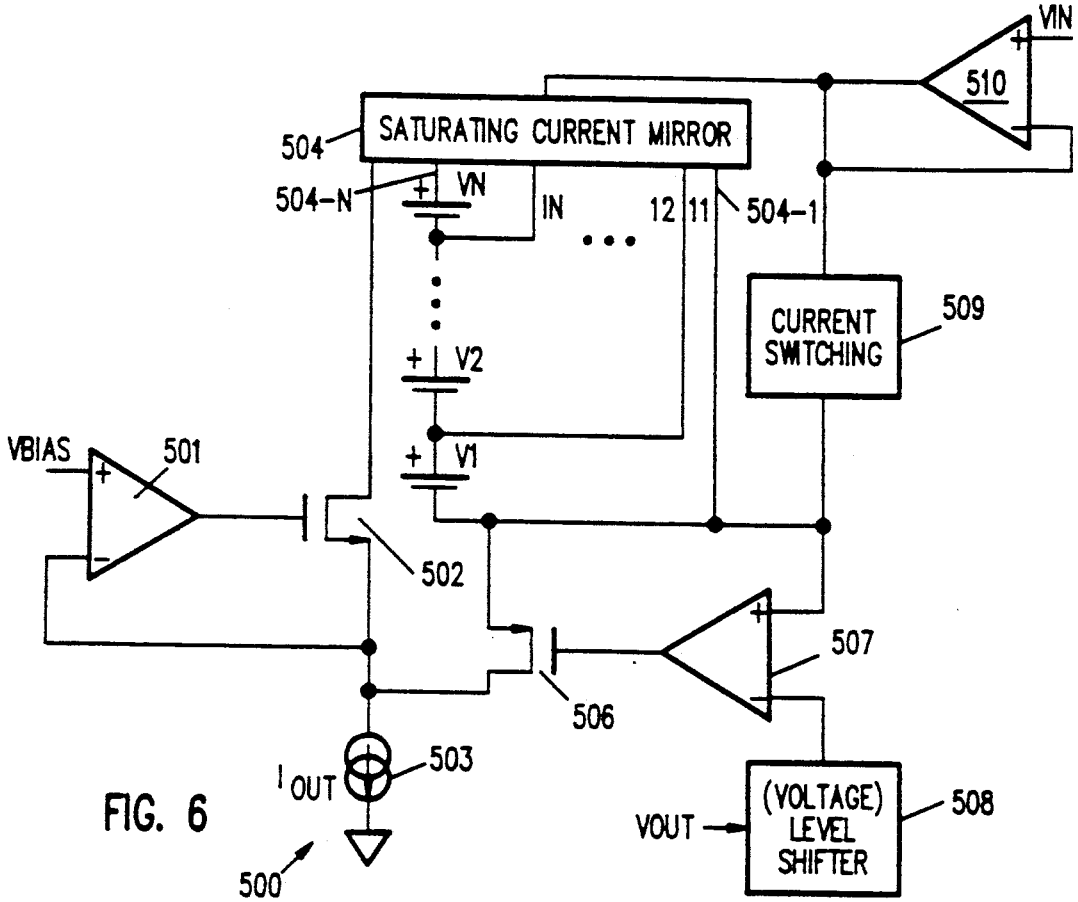
FIG. 6 is a schematic diagram of one embodiment of a current source constructed in accordance with the teachings of this invention utilizing a saturated current mirror.

FIG. 6 is a schematic diagram of another embodiment of this invention. Circuit 500 includes differential amplifier 510 which receives input voltage $V_{in}$ on its noninverting input lead. Its inverting input lead is connected to its output lead which in turn is connected to saturating current mirror 504. Saturating current mirror 504 includes a number of output leads 504-1 through 504-N which are connected to a variety of voltage sources $V_1$ through $V_n$, respectively. These voltage sources serve to provide a current path for currents $I_l$ through $I_n$, respectively, as input voltage $V_{in}$ increases above voltage levels $V_l$ through $V_n$, respectively, thereby causing the output current $I_{out}$ to decrease with increasing input voltage $V_{in}$. By utilizing a desired set of voltages $V_l$ through $V_n$ of desired magnitudes, the output current function is tailored to any desired accuracy as a function of $V_{in}$. For example, for very small step sizes between voltages $V_l$ through $V_n$, the step sizes of output current $I_{out}$ in response to input voltage $V_{in}$ will be small. If desired, the step sizes between voltages $V_l$ through $V_n$ are equal, although they need not be.

Circuit 500 also includes differential amplifier 501 which receives a bias voltage $V_{bias}$ on its noninverting input lead, and whose output lead drives transistor 502 in order to provide output current $I_{out}$. Of course, the voltage applied to transistor 502 by saturating current mirror 504 is established by the amount of current $I_l$ through $I_n$, as established by voltages $V_l$ through $V_n$, respectively.

Figure 7A:
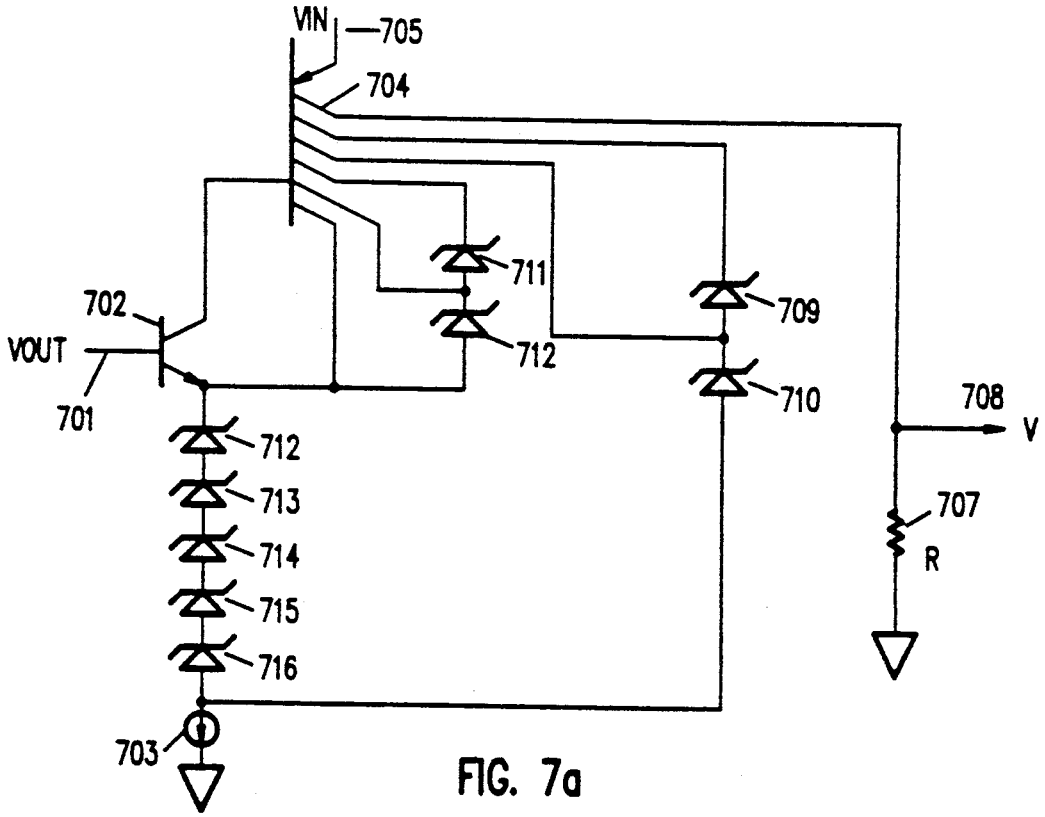
FIG. 7*a* is a schematic diagram of another current source constructed in accordance with the teachings of this invention utilizing a bipolar transistor having a plurality of collectors.

FIG. 7*a* is a schematic diagram of another circuit constructed in accordance with the teachings of this invention. The operation of the circuit of FIG. 7*a* is easily understood with reference to the graph of output current versus input voltage shown in FIG. 7*b*. Assume 0.1 volt saturation for PNP transistor 704, 0.7 forward biased volt base-emitter voltage drop, and 7 volt Zener voltage drop. Then Zener diodes 709 through 712 conduct for the following situations:

(a) all Zener diodes 709 through 712 conduct:

$$V_{in} \geqq V_{out} + 0.1v + (2 \times 7v) + (5 \times 0.7v)$$
$$= V_{out} + 17.6v$$

This yields $$V_{in} - V_{out} \geqq 17.6v$$

(b) for $17.6v > V_{in} - V_{out} \geqq 14.1v$, Zener diode 710 is off.

(c) for $14.1v > V_{in} - V_{out} \geqq 10.6v$, Zener diodes 710 and 712 are off.

(d) for $10.6v > V_{in} - V_{out} \geqq 7.1$, Zener diodes 709, 710, and 712 are off.

(e) for $7.1v > V_{in} -$ Vphd out, all Zener diodes 709 through 712 are off.

| | |
|---|---|
| Condition (a) I | $= 5I_x$ |
| $I_x$ | $= I/5$ |
| (b) I | $= 4I_x$ |
| $I_x$ | $= I/4$ |
| (c) $I_x$ | $= I/3$ |
| (d) $I_x$ | $= I/2$ |
| (e) $I_x$ | $= I$; |
| where $I_x$ | = the current per collector in PNP transistor 704. |

Figure 7B:
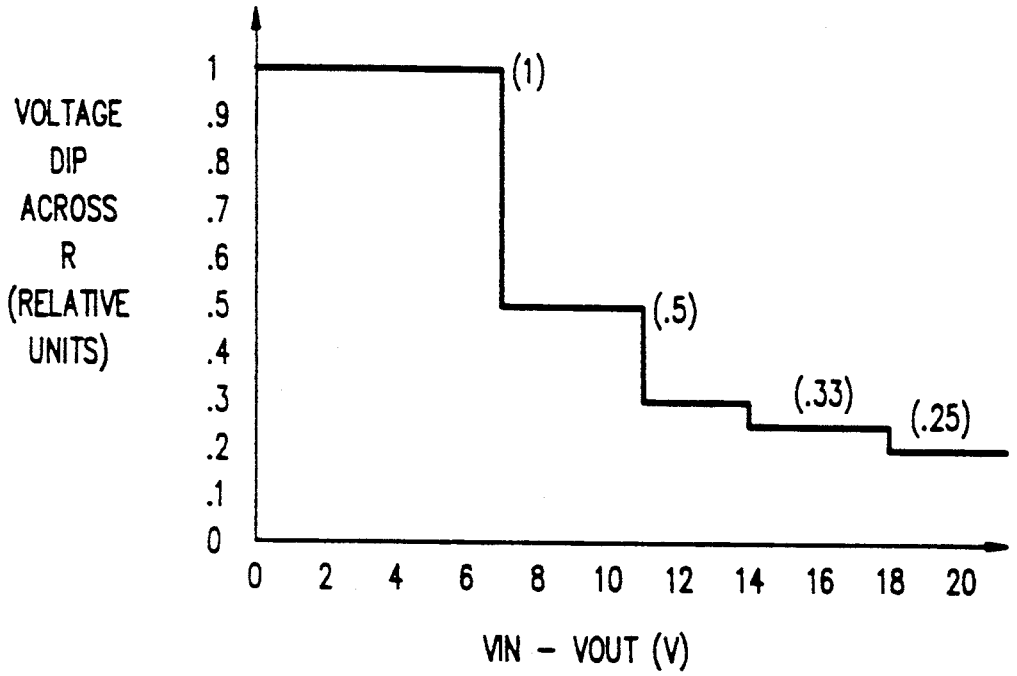
FIG. 7*b* is a graph depicting the transfer function of the circuit of FIG. 7*a;*

As shown in FIG. 7*b*, the output current available on lead 708 has a step function corresponding to the number of Zener diodes 709 through 712 which are turned on. With a low $V_{in}$-$V_{out}$, all Zener diodes 709 through 712 are non-conducting, and maximum voltage drop across resistor 707 (and thus maximum output current) is obtained. At approximately $V_{in} - V_{out} = 7.1$ volts, Zener diode 711 begins to conduct, thereby reducing the voltage drop across resistor 707. A second stepwise decrease in the voltage drop across resistor 704 occurs when $V_{in} - V_{out}$ increases to approximately 10.6 volts, when Zener diode 709 begins to conduct. Additional stepwise decreases occur when $V_{in} - V_{out}$ increase approximately 14.6 volts and 16.6 volts when Zener diodes 712 and 710 begin to conduct, respectively.

Figure 8:
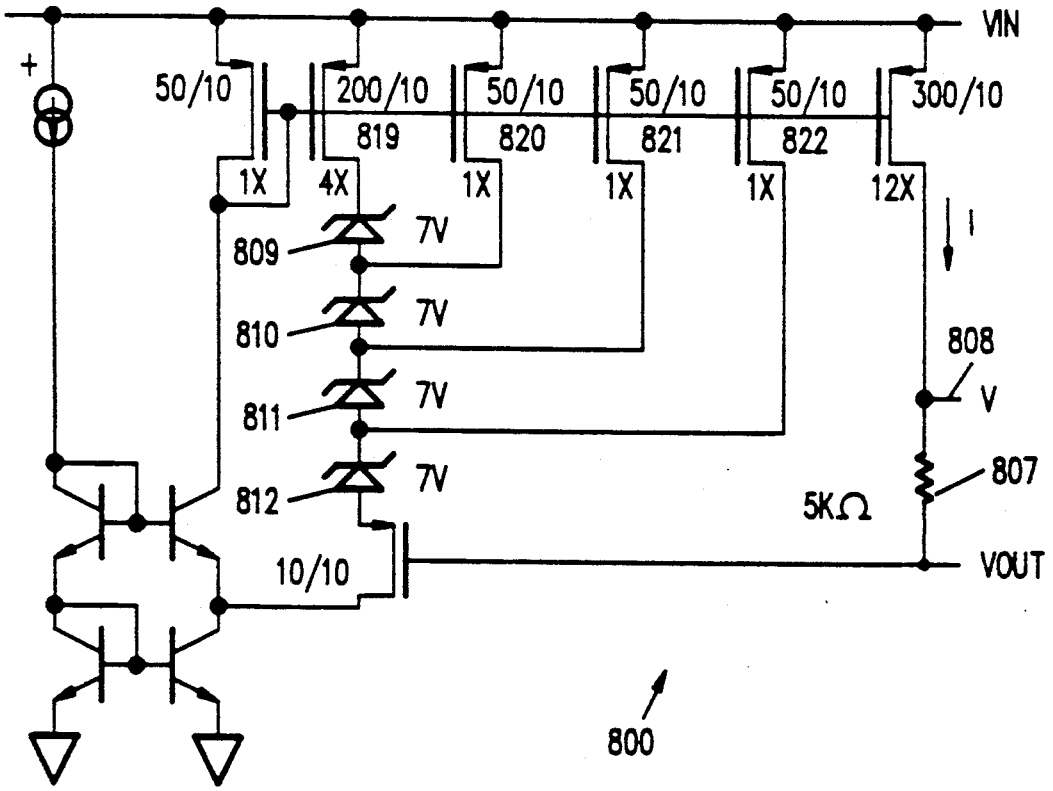
FIG. 8 is a schematic diagram of one embodiment of a current source constructed in accordance with the teachings of this invention which utilizes a plurality of MOS transistors.

FIG. 8 is a schematic diagram of another embodiment of this invention which utilizes MOS transistors rather than bipolar transistors in order to cause Zener diodes 809 through 812 to conduct current through associated transistors 819 through 822, respectively, in order to cause a stepwise decrease in output current $I_{out}$ made available on lead as input voltage $V_{in}$ increases. For the embodiment depicted in the schematic diagram of FIG. 8, let $I_x$ = the current flowing through a suitably sized P channel MOS transistor.

(a) For $V_{in} - V_{out} < 7v + V_{gs}$, all Zener diodes 809 through 812 are off and $I_x = I_{in}$ (b) For $7v \leqq V_{in} - V_{out} - V_{gs} < 14v$, only Zener diode 812 is on $$I_{in} = 2I_x$$

so $I_x = I_{in}/2$

For $14v \leqq V_{in} - V_{out} - V_{gs} < 21v$, Zener diodes 812 and 811 are on, and thus $$I_x = I_{in}/3$$

(d) For $21v \leqq V_{in} - V_{out} - V_{gs} < 28v$, Zener diodes 810, 811, and 812 are on, and thus $$I_x = I_{in}/4$$

(e) For $28v + V_{GS} < V_{in} - V_{out}$, all Zener diodes 809 through 812 are on $$I_{in} = 3I_x + 4I_x$$

$$I_x = I_{in}/7$$

In all conditions, $I = 12I_x$.

In one embodiment of this invention, for example the embodiment of FIG. *7a*, the area sizes of collectors 706-1 through 706-6 are scaled by the desired size relationships in order that the step sizes and output current are not equal. For example, for a collector having twice as much area as another, its effect on the decrease in the available output current will be twice as much. In another embodiment of this invention, for example, that of FIG. 8, the channel widths of transistors 819 through 822 are scaled in order to have a similar effect.

Figure 9:
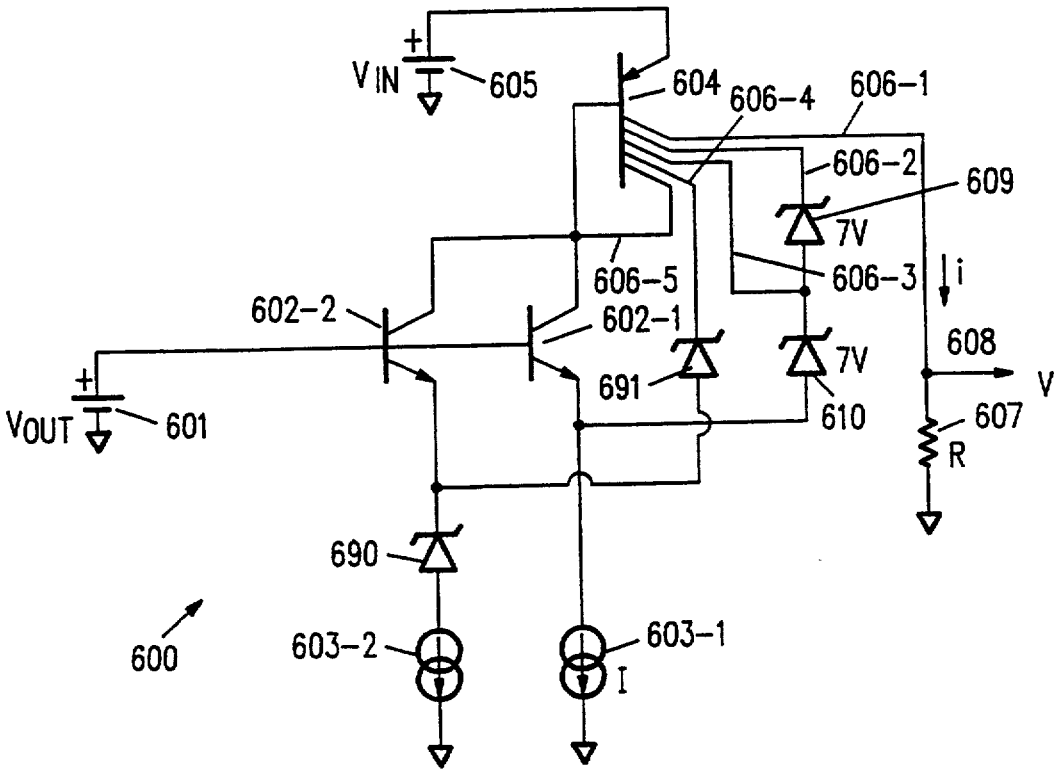
FIG. 9 is a schematic diagram of an alternative embodiment of a current source constructed in accordance with the teachings of this invention utilizing bipolar transistors.

FIG. 9 is a schematic diagram of an alternative embodiment of a current source constructed in accordance with the teachings of this invention similar to that depicted in FIG. *5a*. The embodiment shown in FIG. 9 utilizes reference numerals similar to those used with reference to the discussion regarding FIG. *5a*, above. The embodiment of FIG. 9 includes an additional current source 603-2 which is coupled to the base of current source transistor 604 via transistor 602-2 which is coupled essentially "in parallel" with transistor 602-1 associated with current source 603-1. The emitter of transistor 602-2 is coupled to current source 603-2 via diode 690, which serves as a voltage shifting device. Alternatively, a forward biased diode is used as diode 690. The emitter of transistor 602-2 is also coupled to collector 606-4 of transistor 604 via voltage shifting diode 691. Collector 606-5 of transistor 604 is connected to its base and to the collector of both transistors 602-1 and 602-2.

Although the foregoing invention has been described in some detail by way of illustration and example for purposes of clarity of understanding, it will be readily apparent to those of ordinary skill in the art in light of the teachings of this invention that certain changes and modifications may be made thereto without departing from the spirit or scope of the appended claims.

What is claimed is:

1. A current source comprising:

an input lead for receiving an input voltage;

an output lead for providing an output current;

a current mirror having an input lead coupled to receive an input signal in response to said input voltage, a plurality of control leads, and an output lead;

a plurality of output current control means, each coupled to a respective one of said control leads of said current mirror, each of said output current control means conducting current from said current mirror when said input voltage reaches a predetermined level associated with said output current control means, thereby affecting the current available on said output lead of said current mirror; and a buffer having an input lead for receiving said input voltage and an output lead coupled to said input lead of said current mirror.

2. A current source as in claim 1 wherein said current mirror comprises a current source transistor comprising:

a base;

an emitter serving as said input lead of said current source;

a first collector coupled to said base and coupled to a second current source;

a second collector serving as said output lead of said current mirror; and a plurality of additional collectors serving as said plurality of control leads of said current mirror.

3. A current source as in claim 2 which further comprises a coupling transistor having a base for receiving an output voltage, a collector coupled to said base of said current source transistor, and an emitter coupled to said second current source.

4. A current source as in claim 3 which further comprises one or more additional current sources coupled to said base of said current source transistor, wherein selected ones of said output current control means are coupled to selected ones of said current sources.

5. A current source as in claim 4 which further comprises voltage shift means associated with at least some of said current sources, such that said output current control means are coupled to associated ones of said current sources with a predetermined voltage translation.

6. A current source as in claim 5 wherein said voltage shift means comprise diodes.

7. A current source as in claim 6 which further comprises one or more additional transistors, each having a collector coupled to said collector of said coupling transistor, a base coupled to said base of said coupling transistor, and an emitter coupled to an associate one of said additional current sources.

8. A current source as in claim 7 wherein at least some of said additional transistors have their emitters coupled to said associated current sources through voltage shift means.

9. A current source as in claim 8 wherein said voltage shift means comprise one or more diodes.

10. A current source as in claim 2 wherein said output current control means are coupled between an associated one of said plurality of additional collectors and said second current source.

11. A current source as in claim 10 wherein said output current control means comprise zener diodes.

12. A current source as in claim 11 wherein said output current control means comprise a plurality of zener diodes connected in series, one end of said series coupled to said second current source, and the other end of said series and the intermediate nodes of said series connected to respective ones of said plurality of additional collectors.

13. A current source as in claim 12 wherein said zener diodes have approximately equal zener breakdown voltages.

14. A current source as in claim 2 wherein said plurality of additional collectors have approximately equal current carrying ability.

15. A current source as in claim 2 wherein said plurality of additional collectors have unequal current carrying ability.

16. A current source as in claim 1 wherein said current source comprises:

a first transistor having a control lead, a first current handling lead serving as said input lead of said current source, and a second current handling lead coupled to said control terminal and coupled to a current source;

a plurality of additional transistors, each having a control terminal coupled to said control terminal of said first transistor, a first current handling lead coupled to said first current handling lead of said first transistor, and a second current handling lead serving as one of said plurality of control leads of said current mirror.

17. A current source comprising:

an input lead for receiving an input voltage;

an output lead for providing an output current;

a current mirror having an input lead coupled to receive an input signal in response to said input voltage, a plurality of control leads, and an output lead; and a plurality of output current control means, each coupled to a respective one of said control leads of said current mirror, each of said output current control means conducting current from said current mirror when said input voltage reaches a predetermined level associated with said output current control means, thereby affecting the current available on said output lead of said current mirror, wherein said plurality of output current control means provide a plurality of steps in said output current with respect to said input voltage, said plurality of steps being of equal values with respect to said input voltage.

18. A current source as in claim 17 wherein said plurality of output current control means are connected in series, and wherein said plurality of control leads of said current mirror are connected to associated ones of the interconnections between said plurality of output current control means.

19. A current source as in claim 3 wherein said current mirror comprises a current source transistor comprising:

a base;

an emitter serving as said input lead of said current source;

a first collector coupled to said base and coupled to a second current source;

a second collector serving as said output lead of said current mirror; and a plurality of additional collectors serving as said plurality of control leads of said current mirror.

20. A current source as in claim 17 wherein said current source comprises:

a first transistor having a control lead, a first current handling lead serving as said input lead of said current source, and a second current handling lead coupled to said control terminal and coupled to a current source;

a plurality of additional transistors, each having a control terminal coupled to said control terminal of said first transistor, a first current handling lead coupled to said first current handling lead of said first transistor, and a second current handling lead serving as one of said plurality of control leads of said current mirror.

* * * * *

UNITED STATES PATENT AND TRADEMARK OFFICE

CERTIFICATE OF CORRECTION

PATENT NO. : 5,068,593

DATED : NOVEMBER 26, 1991

INVENTOR(S) : MICHAEL E. WRIGHT

It is certified that error appears in the above-identified patent and that said Letters Patent is hereby corrected as shown below:

In the drawings:

Add the Drawing Sheet, consisting of Fig. 9 as shown on the attached page.

Signed and Sealed this

Seventeenth Day of January, 1995

*Attest:*

*Attesting Officer*

Bruce Lehman

BRUCE LEHMAN

*Commissioner of Patents and Trademarks*